US005930869A

United States Patent [19]

Faas et al.

[11] Patent Number: 5,930,869

[45] Date of Patent: Aug. 3, 1999

[54] SCANNING SENSOR FOR ADJUSTMENT OF A TEXTILE MACHINE CARD CLOTHING GAP

[75] Inventors: Jürg Faas, Andelfingen; Christian Sauter, Flurlingen, both of Switzerland

[73] Assignee: Machinenfabrik Rieter AG, Winterthur, Switzerland

[21] Appl. No.: 08/824,604

[22] Filed: Mar. 26, 1997

[30] Foreign Application Priority Data

Apr. 12, 1996 [CH] Switzerland ..... 0934/96
Apr. 12, 1996 [CH] Switzerland ..... 935/96

[51] Int. Cl.[6] ..... D01G 15/00

[52] U.S. Cl. ..... 19/98; 19/104; 19/110; 19/112; 19/113

[58] Field of Search ..... 19/98, 104, 110, 19/112, 113; 57/408

[56] References Cited

U.S. PATENT DOCUMENTS

| | | | |
|---|---|---|---|
| 4,272,868 | 6/1981 | Grunder et al. | 19/98 |
| 4,384,388 | 5/1983 | Mondini . | |
| 4,494,204 | 1/1985 | Hosel . | |
| 5,040,272 | 8/1991 | Fritzsche . | |
| 5,181,295 | 1/1993 | Demuth et al. . | |
| 5,355,560 | 10/1994 | Fritzsche et al. | 19/98 |
| 5,625,924 | 5/1997 | Sauter et al. | 19/98 |
| 5,642,553 | 7/1997 | Leifeld | 19/112 |

FOREIGN PATENT DOCUMENTS

| | | | |
|---|---|---|---|
| 485881 | 5/1992 | European Pat. Off. | 19/98 |
| 0565486 | 10/1993 | European Pat. Off. . | |
| 0565486A1 | 10/1993 | European Pat. Off. . | |
| 0627508A1 | 12/1994 | European Pat. Off. . | |
| 0701012A1 | 3/1996 | European Pat. Off. . | |
| 2948825C2 | 12/1980 | Germany . | |
| 4115960A1 | 11/1992 | Germany . | |
| 4235610A1 | 4/1994 | Germany . | |
| 9533875 | 12/1995 | WIPO . | |

OTHER PUBLICATIONS

Patent Abstract of Japan, No. 01239119, published Sep. 25, 1989.

EPO Search Report, Jul. 30, 1997.

Pages 48–52, The Textile Institute Manual of Textile Technology, "A Practical Guiide to Opening and Carding", vol. 2, Jun. 16, 1987.

*Primary Examiner*—William Stryjewski
*Attorney, Agent, or Firm*—Dority & Manning

[57] ABSTRACT

The carding distance (KA) between clothings (14, 15) is scanned using an optical device (22, 26) e.g. using a laser beam (24) from the side of the working area. The measuring value thus obtained can be compared to a pre-set target value in such a manner that the distance mentioned can be adjusted. Card with a controllable actuator system (32, 34) for setting the carding gap between the clothing on the main drum and the clothing on the flats, and with a programmable control system (12) which can influence the actuator system. A sensor system (26, 28) measures the carding gap in order to render regulation of the gap possible. The control system obtains, and processes respectively, data connected with the state of the clothing. The control system (12) is programmed in such a manner that regulation is effected as long as the measuring values supplied by the sensor system appear to be "plausible". If the plausibility no longer is ensured, the control system can deactivate the regulation steps and possibly can itself take over the adjustment process.

29 Claims, 5 Drawing Sheets

Fig. 4
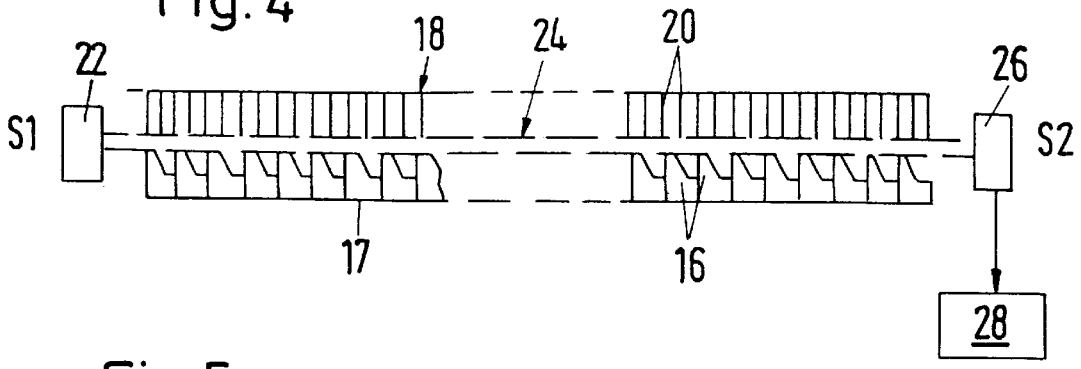
Fig. 5
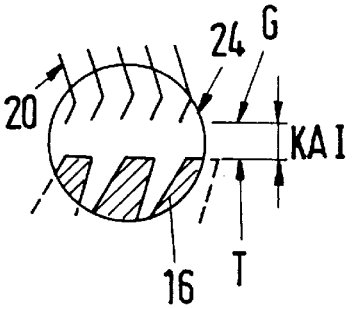
Fig. 6
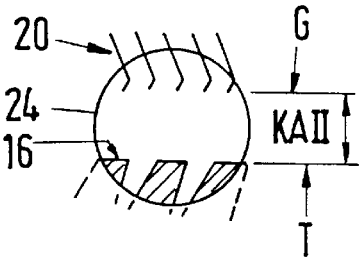
Fig. 7
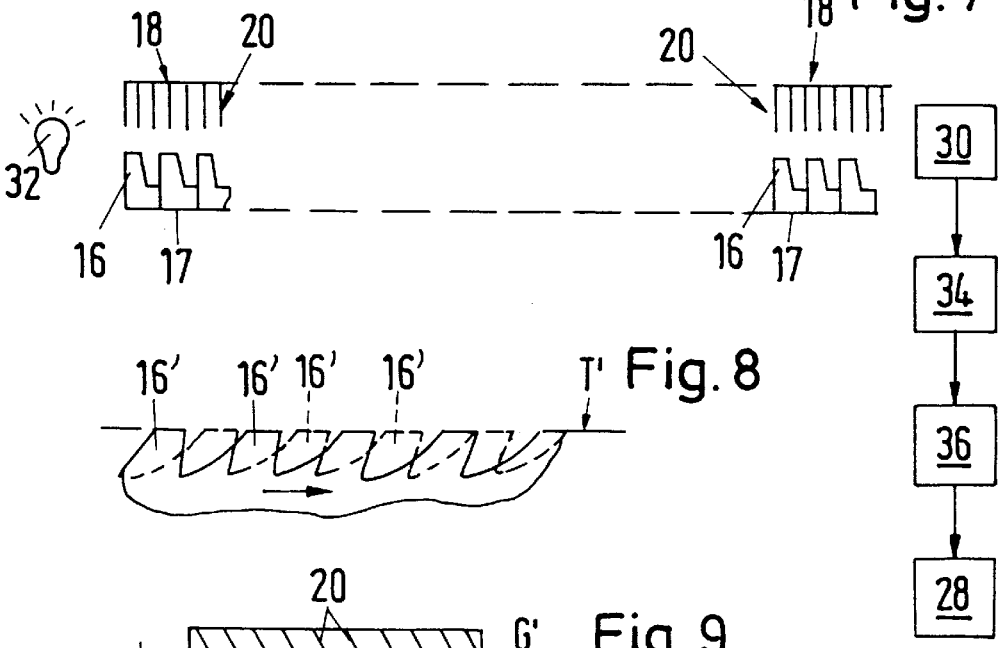
Fig. 8
Fig. 9
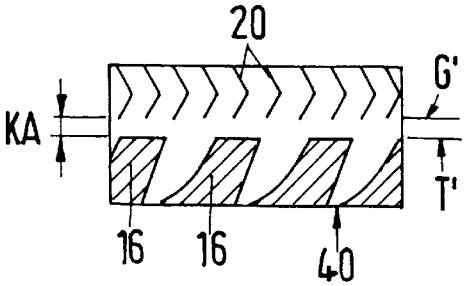

SCANNING SENSOR FOR ADJUSTMENT OF A TEXTILE MACHINE CARD CLOTHING GAP

BACKGROUND OF THE INVENTION

The present invention concerns a sensor for scanning the working distance between cooperating card clothings (also called carding gap), i.e. the actual distance of the points of a card clothing to a machine element facing it. This machine element also can be covered with clothing but could also be represented by a cover element provided with a guide surface instead. The present invention in particular is aimed at measuring the working distance between the main drum and the flats of a revolving flat arrangement, but is not restricted to this lay-out.

The present invention also concerns an "on-line" control system influencing the carding gap i.e. without interrupting the card operation. The present invention is conceived to be applied, but no exclusively, to a revolving flat card.

Significance of the carding gap/starting point:

The carding gap is the distance between a clothing and an element facing the clothing. The size (width) of the carding gap is an important machine parameter characterizing the fibre processing technology as well as the running properties of the machine. The carding gap is set as narrow as possible (being measured in tenths of a millimeter) without taking the risk of a "collision" between the working elements. If uniform processing of the fibres is to be ensured, the gap width is to be maintained equal as far as possible over the full working width of the machine. The working width of a conventional revolving flat card is about one meter, larger cards having been proposed.

The carding gap is influenced by two basic factors, namely the machine settings and the condition of the clothing.

The most critical carding gap is located in the main carding zone, i.e. between the main drum and the revolving flat arrangement. The width of this gap traditionally, since decades, is set using a so-called flexible arch. The setting procedure, however, requires specially trained personnel and the machine cannot be operated while being set. The setting procedure thus normally is repeated only if the machine is re-clothed, or after a clothing service, i.e. after time intervals ranging from several months to up to two years. It is known, however, that the carding performance could be "optimised" if the machine elements were adjusted "on-line" in so far as the unavoidable changes in the state of the clothing could be off-set partially at least by correspondingly adapting the machine settings.

STATE OF THE ART CONCERNING CARDING GAP SENSING

DE-C-29 48 825 proposes (Column 7, lines 15 through 22) measurement of a distance (designated "a") directly in the card. From the description of this distance "a" (Column 4, lines 55 through 57) it can be established for certain whether the working distance in the above mentioned sense is of concern. In any case, no indications whatsoever are stated as to how the desired effect could be achieved.

A similar goal again has been taken up in DE-A-42 35 610. In this case a measuring sensor is to be provided in the clothed area. The sensor generates a measuring field extending in the direction of one of the clothings. The "height position" of the sensor relative to the other clothing is predetermined. It is unclear in which manner the system should react to changes (e.g. onto wear) in the second clothing (comp. FIGS. 2 and 4C of DE-A-42 35 610).

The task of the sensor system:

A "clothing" consists of a great number of individual of projections ("points") protruding from a support surface into the working space of a card (see "Handbuch der textilen Fertigung" (Handbook of Textile Manufacturing), Volume 2: Putzerei und Karderie (opening and Cleaning, Carding) (The Textile Institute, Author: W. Klein). These points are arranged in the densest possible arrangement without presenting a continuous surface which could be scanned as such.

The working distances between the clothings in a modern card already are very small (being measured in tenths of a millimeter) and further reductions are striven for. The working width of the card (i.e. the width of the areas provided with clothing where fibres are to be processed as uniformly as possible) is of about one meter or more. The working distance is to be the same across the full working width.

At least one of the clothings adjacent to the working distance moves, in most cases both of them. In order to increase card production, the operating speed of rotation and the operating speed of the movable elements are chosen as high as fibre processing technology permits.

The working distance changes as a function of the operating conditions, as explained accurately in the description of the state of the art mentioned above. A repetition of the description can be dispensed with here, as any specialist in the field is familiar with. The change occurs in the radial direction (as seen from the axis of the main drum).

Apart from the small dimensions of the working distances to be measured, there is not much room inside the card.

SUMMARY OF THE INVENTION CONCERNING "SENSOR SYSTEMS"

The present invention is based on the recognition concerning sensor systems, that the actual working distance can be inferred only if said distance is scanned "laterally" (across the working width). This is due to the changes occurring in the distance to be measured—the direction of scanning must be chosen transversely with respect to the "direction of changes".

A sensor device is desirable which is effective across the full working width rim to rim, and which of course functions contact-free. Such requirements can be met only if a ray is applied, e.g. a beam of light, in particular a laser beam. The beam could be directed across the working area in such a manner that it is partially scattered (or "held up" respectively) by the elements adjacent to the working distance, in which arrangement the degree of scatter or the remaining light is used as a reference for the distance to be measured.

The measuring principle mentioned, however, is very demanding as to the precision alignment of the measuring device, as well as to the analysis and evaluation of the signals obtained. Instruments which can meet such requirements as a rule are sensitive to outside influences such as vibrations, temperature, dust contents of the surrounding air, fly waste contamination, etc. Such instruments thus possibly may not prove robust enough for long term application under spinning mill conditions, which does not exclude their short term application e.g. during the start-up of the machine (determining the basic settings) or during maintenance (mounting of new clothing).

A relatively robust device on the other hand will not be capable of "penetrating" into the working area, i.e. only the conditions prevailing in the lateral rim zones of the working area can be scanned. Provided these conditions are representative of the full working area, said instrument can achieve the main task. The measurement values obtained in one lateral zone can be supplemented by measuring results obtained using other means, e.g. a method according to DE-A-42 35 610. In the last analysis, achieving a part-task only also can prove useful.

A relatively robust instrument capable of scanning a lateral rim zone only can comprise e.g. a camera cooperating with an analyser device by which an image can be analysed. A problem which may occur is due, as mentioned before, to the fact that a clothing (also as seen from the side) does not form a continuous (solid) surface, which might render analysis considerably more difficult. This problem could be attenuated by choosing the "aperture setting", or the shutter speed respectively, of the camera (be it mechanical or electronic) so slow in comparison to the speed of movement of the clothing elements that the elements nevertheless appear as a (sufficiently) solid surface. The same effect could be obtained if pictures taken sequentially are superimposed in order to form the composite image to be analysed which an be easily achieved by an electronic analyser device. In this process, digitising and storing of the image signals are of importance—corresponding image processing devices preferentially are to be provided in the analyser device.

STATE OF THE ART CONCERNING THE ADJUSTMENT

The concept of "continuous" adjustment is mentioned in DE-C-29 48 825 where a working distance is adjusted as a function of a quantity related to the dimensions of a main drum of a card (to the main drum diameter) in which situation the quantity can be a "distance a" (column 7, line 18). Continuous adjustment of the revolving flat arrangement is shown in the FIGS. 3 and 4. In the document cited, attempts to measure the distance "a" are rather advised against, however (column 7, lines 28 to 31).

EP-C-384 297 and DE-A-42 35 610 mainly deal with the problem of measuring quantities of importance for judging a carding gap. A control device for the carding gap is mentioned in both documents, but no concrete proposals of realisation can be found therein. In DE-A-41 15 960 a system is provided effecting the adjustment on the basis of (quality) control of the card sliver delivered by the card.

EP-A-627 508 also deals with the problems of the measuring system, but also in the FIGS. 12 and 13 shows proposals concerning the actuator systems which could be applied in the adjustment of machine elements.

In spite of all the proposals cited, no control system ready for application in practice has been achieved. The remaining problems on one hand are seen in the high expenditure, and on the other hand still in the reliable scanning to obtain a relevant measurement value as a guide for the controlling action, as well as in the high risks involved resulting from a possible malfunction. It must be borne in mind that the card fulfills an essential function in all types of opening and cleaning plants (no alternative processes, no matter which spinning method is applied), and that any opening and cleaning plant comprises a plurality of cards, that controlling some individual cards only (except for experimental purposes) hardly would be worth the trouble, that the cards are in operation more or less continually and that 100% long term reliability of the sensors hardly can be expected. Furthermore, if a "fatal crash" occurs the whole machine itself possibly may be a total loss (causing corresponding resulting costs).

Thus, it is easily understood that more cautious "strategies" have been developed to make "adjustment without machine shut-down" feasible without taking the high risks, which arise if the system depends on hard to verify measuring results. A proposal of such type is found in WO 95/33875 in which setting devices are provided which can be operated manually for effecting a predetermined adjustment of the machine settings. This system is as reliable and as precise as the human operators applying it. The still unpublished Patent Application EP 96 101 466 by the applicant, dated Feb. 2, 1966 (U.S. Ser. No. 08/508704, dated Jul. 28, 1995) describes a controllable actuator system which permits the readjustment based on guide values which an be derived from the operating conditions of the machine, e.g. from the operating time and the production influencing the current state of the clothing. These guide values showing indirect connection merely to the carding gap on the other hand are more easily and more reliably determined and they permit provision of wider safety margins.

SUMMARY OF THE INVENTION CONCERNING "ADJUSTMENT"

This aspect of the present invention provides a card with a clothing, an element facing this clothing and a controllable actuator system for adjusting the carding gap between the clothing and the element. The card furthermore comprises a programmable control system acting on the actuator system. Furthermore the card is provided with a sensor system arranged for obtaining at least one measuring value connected to the carding gap, the corresponding sensor signals being transmitted to the control system. The control system furthermore is laid out in such a manner that it obtains, or acquires respectively, data connected to the state of the clothing. These single elements are known individually from the state of the art (not, however, combined in one document). According to the present invention, these elements are interlinked in such a manner that under predetermined working conditions ("pre-set conditions"), the carding gap is regulated on the basis of the measuring values supplied by the sensor system, the control system being programmed in such a manner that the regulating action can be rendered inactive if the pre-set conditions are not met (any more). The control system also can be programmed in such a manner that the carding gap can be further adjusted by the control device on the basis of control signals, also without, if need arises, taking the measuring values into account which are supplied by the sensor system. In other words, the control system is programmed in such a manner that it permits gap regulation as long as the measured values supplied by the sensor system seem "plausible". If plausibility no longer is given, the control system can deactivate the regulating system and, possibly, can itself take over control of the adjustment.

In the preferred solution, the control system is programmed in such a manner that an "approach limit" is defined for the regulation in such a manner that an undesirable narrowing of the carding gap (e.g. due to a faulty measurement, to faulty analysis, or to faulty communication) is to be excluded.

The pre-set conditions which effectively limit the range of validity of the regulation also can be incorporated into the control system, in which arrangement the control system must be capable of checking during operation whether the pre-set conditions are met or exceeded. Preferentially, checking of the fulfillment of the pre-set conditions can be effected on the basis of data which are checked anyhow (for other reasons) by the control system. Such data are e.g.:

operating time accumulated since the last maintenance service, total production since the last maintenance service, the type of material processed, the (accumulated)effect of built-in maintenance devices (e.g. according to EP-C-565 486).

Special means also can be provided for generating data directly representing the fulfillment of the pre-set conditions, e.g. a sensor indicating the deviation of the position of the adjusting system from a predetermined "base setting".

The sensor system can function according to a known principle, e.g. according to DE-C-29 48 825, or EP-C-384 297, or DE-A-42 35 610, or DE-A-41 15 960. The preferred sensor system, however, functions according to the principle of the sensor system mentioned above in which the carding distance is scanned contact free from the side of the working area.

The actuator system also can function according to known principles, e.g. according to DE-C-29 48 825, or EP-A-627 508, or (in the preferred embodiment) according to the EP Application Nr. 96 101 466 dated Feb. 2, 1996.

The clothing mentioned can be mounted on the main drum and the carding gap to be regulated or controlled, respectively, can be located in the main carding area (between the clothing on the main drum and the clothing on the flats).

Embodiments of the present invention are described in more detail in the following with reference to illustrated design examples. It is shown in:

BRIEF DESCRIPTION OF THE DRAWINGS

FIG. 4 illustrates schematically a first embodiment according to the invention concerning the sensor system shown as a modification of the arrangement illustrated in the FIG. 3, FIG. 5 is a detail according to the FIG. 4 viewed from the side (transversely to the viewing direction according to the FIG. 4), FIG. 6 is the same detail, the carding (working) distance being changed, FIG. 7 shows schematically a second embodiment according to the invention concerning the sensor system also shown as a modification of the arrangement illustrated in the FIG. 3, FIG. 8 is a schematic view of the points of the clothing on the main drum (as viewed from the side) illustrating the function of the second embodiment, FIG. 9 is a side view of the working area according to the FIG. 2 explaining the function of the second embodiment in more detail.

DETAILED DESCRIPTION OF THE PREFERRED EMBODIMENTS

Figure 1:
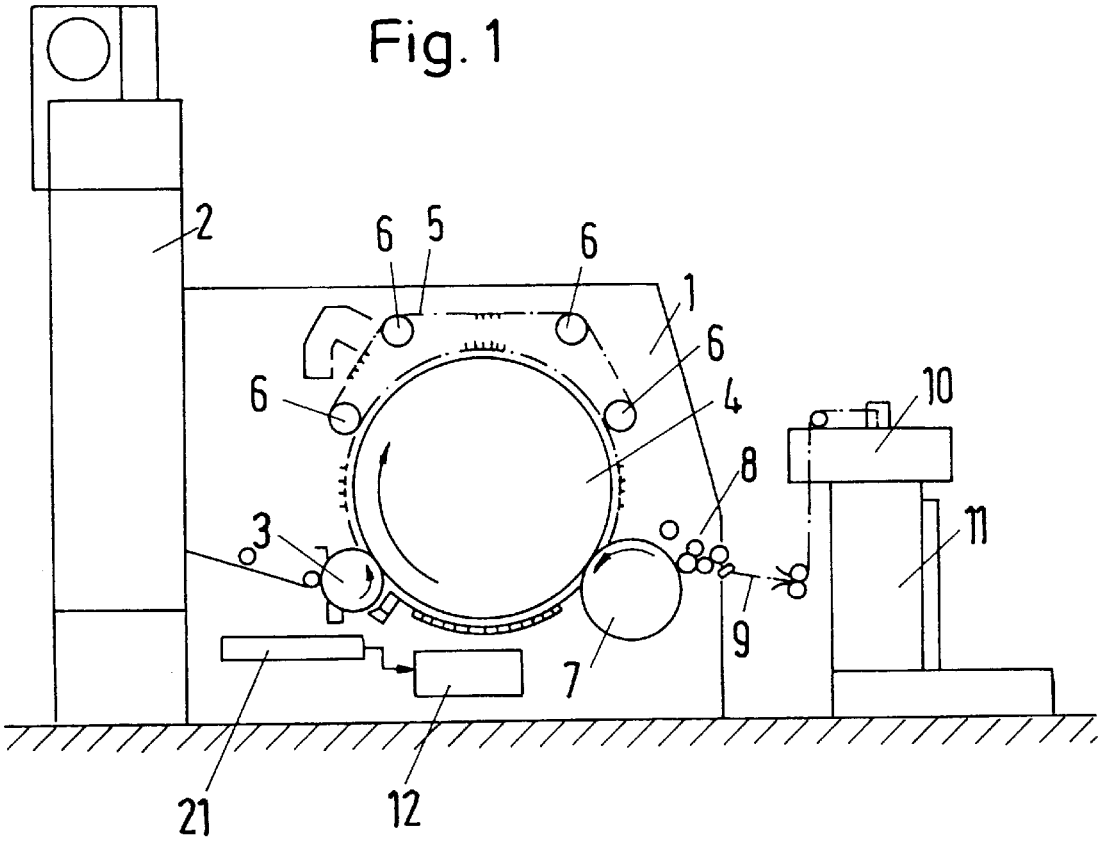
FIG. 1 is a schematic view of a card.

Reference will now be made in detail to the presently preferred embodiments of the invention, one or more examples of which are illustrated in the drawings. Each example is provided for explaining the invention, and are not meant as limitations of the invention.

In the FIG. 1, a revolving flat card known as such, e.g. the card C50 build by Machinefabrik Rieter A.G., is shown schematically. The fibre material to be processed is fed in the form of opened and cleaned fibre flocks into the chute feed 2, is taken over as a lap by a taker-in 3, also called licker-in, is transferred to a main drum 4 and is opened and cleaned between the cooperating main drum and a set of revolving flats 5. The flats of the set of revolving flats 5 are guided, driven by a suitable drive system, along a closed path (in the same direction of the main drum rotation or in the opposite direction). Fibres from the web located on the main drum 4 are taken off by a doffer roll 7 and in a delivery roll arrangement 8 are formed into a card sliver 9. This card sliver 9 is deposited by a coiler device 10 into a transport can 11 in cycloid windings.

The angle sector of the main drum circumference directly facing the set of revolving flats can be designated as "main carding area"; most of the carding work is performed therein. The angle sector between the licker-in 3 and the set of revolving flats can be designated as "Pre-carding area" and the angle sector between the set of revolving flats and the doffer roll 7 as "after-carding area". Finally the angle sector between the doffer roll 7 and the licker-in 3 can be designated as "under-carding area". The present invention in particular concerns the measurement of the carding distance in the main carding area and the subsequent figures show this area exclusively. The present invention, however, is not limited to this application, as it can be applied also to the measurement of the distance between the clothing on the main drum and other elements facing it, as in conclusion will be explained briefly in more detail.

Figure 2:
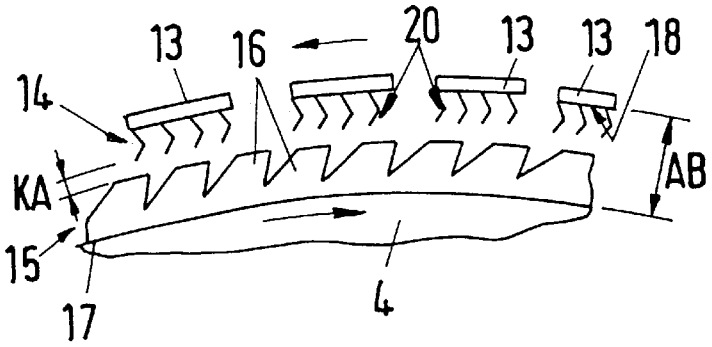
FIG. 2 illustrates four flat bars schematically shown in their working position facing the main drum, the elements shown being viewed from the side (in the same direction as in the FIG. 1)

The set of revolving flats 5 comprises flat bars which in the FIG. 1 are not shown in detail but are indicated in the FIG. 2 with the reference sign 13. Each flat bar is provided with a strip of clothing 14 which, in the embodiment shown in the FIG. 2, is designed as a "semi-rigid" or as a flexible clothing (compare the handbook cited before, volume 2, page 52). The main drum 4 also is provided with a clothing 15 designated as a metallic card clothing with points 16. The (opposed) directions of movement are indicated by the arrows; the flat bars also could move in reverse direction (same direction as the main drum). The area AB between the cylindrical surface 17 of the main drum 4 and the curved surface 18 formed by the flat bars 13 herein is designated "working area". A flat bar 13 is located in its "working position" if its clothing 14 extends into the working area AB.

The radial depth of the working area AB can be determined in the design of the machine, in which process certain influences caused by the operation must be taken into account. Such influences are e.g. the rotational operating speed of the main drum influencing the expansion of the main drum under the influence of the centrifugal force, and the heat generated or the cooling effect respectively (if applied), which influence the changes in the working elements under the influence of the operating temperatures. The depth of the working area AB as such is less important for carding quality than the "carding distance" (or carding gap respectively) KA between the points of the clothings 14, 15. The carding distance KA is influenced by the depth of the working area AB as the clothings extend from the surfaces 17, 18, but it is influenced also by wear to which the points are subject while the card is in operation. This wear partially is caused directly as fibres are processed, and partially also due to grinding operations performed periodically in order to ensure the predetermined quality of the carding action on the long run.

It is a long-standing wish of the design engineers to be able to measure the carding distance KA contact-free for various reasons, e.g. to be able to:

determine objectively the base settings of the card during the mounting of the card, or during maintenance services respectively, indicate the value of the carding distance, which is a help to the operators, control the value of the carding distance.

None of the proposed solutions thus far was able to convincingly fulfill this long-standing wish. New approaches for such solutions are described in more detail with reference to the FIGS. 4 to 11. First the problem is explained in more detail in the FIG. 3.

Figure 3:
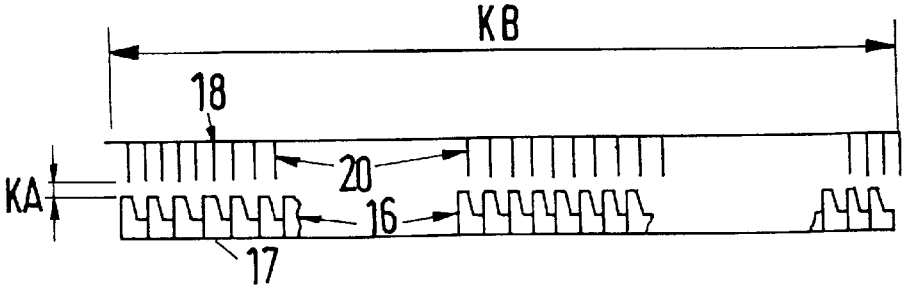
FIG. 3 shows schematically a part of the working area of the card according to the FIG. 2 seen in circumferential direction (transversely to the viewing direction assumed in the FIG. 1)

In the FIG. 3, again the cylindrical surface 17 of the main drum 4 is shown and the curved surface 18 of the working position of the flat bars 13 over the full working width KB of the card. The working width KB in a presently conventional card processing cotton fibres or fibres of corresponding staple length is about 1 meter. The wires 20 and the points 16 of the clothings 14, 15 are also shown partially in the FIG. 3, again for indicating the carding distance KA, where it is to be noted that the relations between the quantities in the Figure are shown distorted in order to render the illustration possible after all. The carding distance in the main carding area of a revolving flat card ranges from 0.2 to 0.25 mm approximately. The FIG. 3 is based on the assumption that the heights of the points of both clothings as well as the depth of the working area AB are constant over the full working width KB. This assumption does not necessarily hold true in practical cases.

A first embodiment according to the present invention is explained in the following with reference to the FIGS. 4 to 6, the general arrangement of the elements in the FIG. 4 corresponding to the one shown in the FIG. 3 and the same reference signs being used as far as possible. The card shown in the FIG. 4 includes a laser device 22 at one side of the card for generating a light beam 24 directed through the working area AB from one side of the card to the other. On the opposite side S2 of the card, a receiver 26 is arranged facing the laser device 22, in which arrangement the receiver 26 transmits an output signal as a function of the intensity of the light beam 24 received to a signal processing device 28. The signal processing analyser can be laid out according to different principles as explained in the following jointly for both embodiments.

In the FIGS. 5 and 6, the laser beam 24 is shown "in cross-section", each with individual points 16 of the clothing on the main drum and individual wires 20 of the clothing on the flat bars. The cross-section of the beam 24 is assumed to be circular, which is not relevant in the frame of the invention, however. It furthermore is assumed that the beam 24 remains stationary in the surrounding room (in the card frame). The arrangements shown in the FIGS. 5 and 6 differ regarding the carding distance—the distance KAI in the FIG. 5 being noticeably smaller than the distance KAII in the FIG. 6, as in the latter case the points 16, 20 have "retracted" due to wear relative to the beam.

In the FIG. 5 a substantial portion of the beam cross-section is "blocked" by the points 16, 20 illustrated in such a manner that a corresponding portion of the beam 24 is scattered ("held back") by the lateral surfaces of the points and thus cannot penetrate to the receiver 26. Considering that neither the points 16 of the clothing 15 on the main drum nor the points 20 of the clothing 14 on the flat bars are distributed in rows but rather in a staggered arrangement across the working width, it is evident that the laser beam 24 practically can penetrate only through the distance KA and that above the envelope curve G and below the envelope curve T the beam is annihilated to a large extent. In the FIG. 6 a noticeably smaller portion of the cross-section of the beam is scattered by the clothings in such a manner that the radiation intensity detected by the receiver 26 is much higher.

The measurement values of course would have been falsified by any movements of the beam relative to the machine frame (the clothings), and of the receiver relative to the beam. Such movements could be caused by e.g. shaking actions, or vibrations respectively. Disturbances of this type normally will be just short-lived whereas a change in carding distance is a relatively slow process. Analysis of the scanned values can be laid out accordingly and steep signal surges could be e.g. filtered off. In this manner, also activation of the system by fibre tufts, particles such as seed particles and individual points exceeding the envelope curve can be avoided.

The embodiment described constitutes an "electronic gauge" reacting to the actual size of the carding distance across the full working width. The laser device 22 can be excited by driver stage (not shown), the beam generated being continuous or pulsed. In the latter case, a common control arrangement (not shown) is to be provided for the laser device 22 and the receiver 26 which thus can be coordinated.

In the FIG. 7, a second embodiment is shown in which the general arrangement also corresponds to the one shown in the FIG. 4 and in which the same reference signs were used. In the case shown, a camera 30 is provided on one side at the height of the working area AB. On the other side of the card, facing the camera, a source of light 32 can be provided which is not required necessarily as the camera practically can scan only the lateral rim zone of the working area. If in this rim zone lightening is insufficient, a source of light (a flash lamp, not shown) can be provided on the same side of the card. The camera 30 takes a snapshot of the rim area facing it and the image gained is digitised by suitable means 34 known as such (shown schematically) and the resulting signal (a sequence of "Bits") is stored in a buffer storage 36. The signal can be examined in the analyser device 28 for the predetermined patterns using today's conventional image processing means. The patterns are discussed in more detail in the following with reference to the FIGS. 8 and 9. A camera each can be provided on either side of the card.

In the FIG. 8 the points 16' of a portion of the other clothing wire windings on the main drum 4 (not shown in the FIG. 8) are shown schematically. The points 16' are shown in solid lines located at first angle positions while the "shutter" of the camera 30 is opened to take a snapshot. A fraction of a second later the same points 16' are located at the angle positions indicated with dashed lines. If the shutter is kept open long enough, the points 16' form an envelope curve T' in the image as they move, resembling an envelope curve T of the arrangement shown in the FIGS. 5 and 6. Even if the shutter is shut immediately, the envelope curve still can be generated if the shutter is re-opened to take a snapshot of the points 16' in their second angle positions, the second image being "superimposed" to the first image. This procedure can be repeated as often as required to build up the required "coherence" of the envelope curve T'. If the image analysis can be applied to additional tasks, generation of the envelope curve T' is not required as it can "derived" by evaluating the positions scanned of the poitns in the image analysed.

The envelope curves T and T' in any case differ in that the curve T' is generated only by the rim points 16' whereas many points of the clothing 15 contribute in generating the envelope curve T. If, however, the rim points 16' are representative for the working conditions across the full working width AB the envelope curves T and T' can be considered as identical.

In the FIG. 9, the field vision or frame 40 of the camera 30 (of the "viewfinder") is shown schematically as well as the rim points 16 and rim clothing wires 20 as seen in the field of vision of the camera 30 as the shutter opens. The "shutter" in this arrangement can comprise a mechanical device but alternatively can consist of an electronic device which changes the state of the camera 30 as to permit taking a snapshot. The field of vision 40 forms a rectangle which is of no consequence in the scope of the invention. The wires 20, exactly as the points 16, form an envelope curve G' and the carding distance KA corresponds to the distance between the envelope curves T', G' which can be determined using the image analysis.

Figure 10:
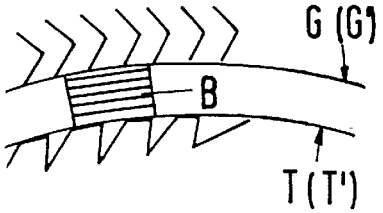
Figure 11:
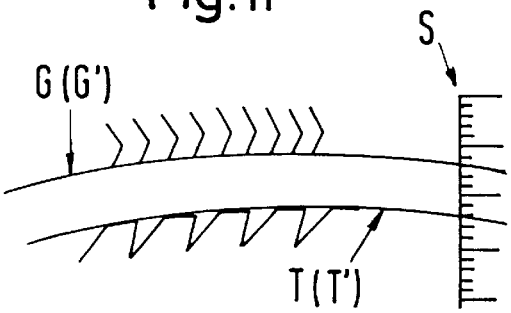

In the FIGS. 10 and 11, each the envelope curves G (G'), and T (T') respectively, are shown which are generated according to either one of the two methods described and stored in an "image" (which may consist of "Bits"). The two Figures illustrate two ways of "analysing" or processing the images. In the FIG. 10, a "fictitious card gauge" is provided which in analysing "inserts" as many "gauge strips" B of a given thickness as required to fill the whole distance. The number of the gauge strips B taken up indicates the distance KA. In the FIG. 11 the analyser device shows a "scale" S in the image on which the distance KA can be read.

Figure 12:
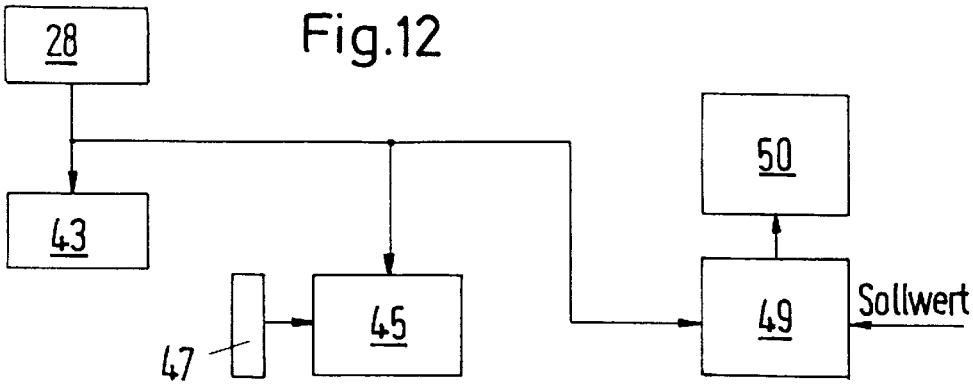
FIGS. 10 through 12 illustrate various possibilities of analysing the images.

In the FIG. 12, three possible ways are shown of making use of the results obtained from the analyser device 28. In a first arrangement the distance determined is displayed on a display 43 e.g. as a number or as a (possibly scaled) drawing to be interpreted by the operator. This arrangement is very useful e.g. for setting the card during assembly as it furnishes objective values independently of the operator (and of his gauge he manually applies).

In a second arrangement, the distance determined is compared with a pre-set limit value (e.g. pre-set via a key board 47) in a comparator device 45 in such a manner that a signal or an alarm signal can be generated as soon as a tolerance margin is exceeded. The tolerance margin can be set by the end user (e.g. the spinning mill foreman), and the resulting "on-line" surveillance is helpful in determining the moment for maintenance services (for example grinding or replacing clothings) but also for signalling disturbances to be investigated by the operator personnel.

In a third arrangement, the distance determined is transmitted to a regulating device 49 which compares it with a pre-set target value in such a manner that if a deviation A from the target value is detected, an actuator system 50 can be activated in order to readjust the position of the flat bars relative to the main drum and thus to even out the deviation. This procedure, permitting an "on-line" optimising, will be described in more detail with reference to the FIG. 13 on the basis of the arrangement according to the FIG. 4 and using the same reference signs for the elements shown identical.

Figure 13:
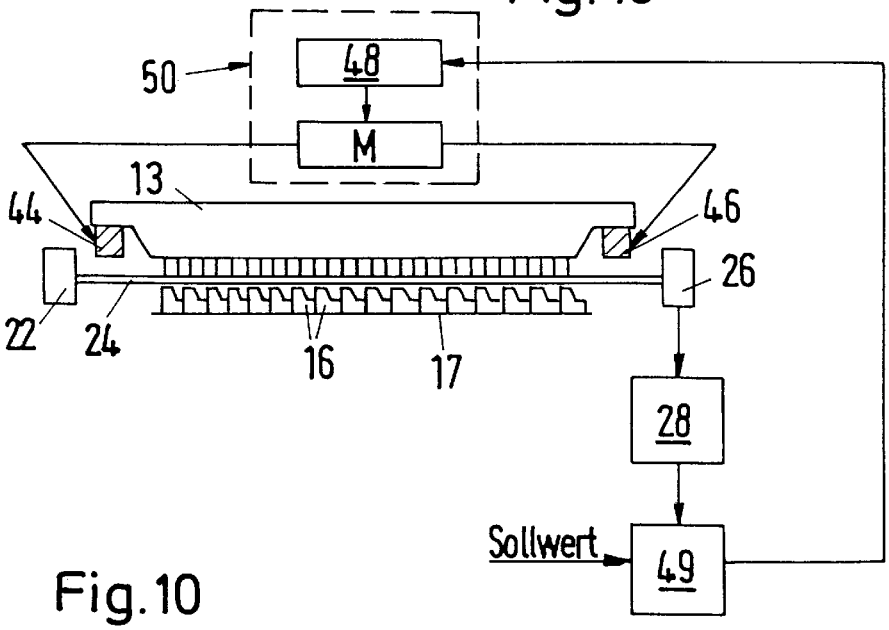
FIG. 13 is a diagram explaining one of the possibilities.

In addition to the elements already described, two flexible arches 44, 46 (one each per card side) are shown in the FIG. 13 on which the flat bars 13 slide. The actuator system 50 mentioned above comprises a motor M and an appropriate motor control device 48 which transforms the output signals transmitted by the comparator device 49 into control signals for the motor M in order to change the position of one or the other or of both flexible arches 44, 46 relative to the card frame (not shown) and thus to correspondingly adapt the carding distance KA. A suitable actuator system for the flexible arch has been shown in EP 96 101 466, dated Feb. 2, 1996. The complete contents of the latter being integrated into the present application so that repetition of the corresponding description can be dispensed with.

Basically the procedure can be chosen as follows:

1) The beam 24 is oriented in such a manner that under certain operating conditions (rotational speed, and temperature, of the main drum, as well as the height of the points 16), a pre-set portion of the beam 24 below the envelope curve T (FIG. 5) is blocked off by the receiver device 26. This (base) state must be set specifically, preferentially by specially trained personnel.
2) The actuator system 50 then is activated in such a manner that the envelope curve G (FIG. 5) is located within predetermined tolerance margins with respect to the envelope curve T. This starting position also is part of the base state which is to be set specifically, e.g. using the display 43 (FIG. 12) and by manually activating the controlled actuator system 50.
3) The regulating device 49, 48 now is switched on which begins to compare the effective value of the carding distance KA with the predetermined target value and controls the motor M in order to eliminate any deviations detected. It thus is not of important that the card before its start-up be set to its base state, as the subsequent changes in the working elements are levelled out during the start-up phase in such a manner that the predetermined carding distance is maintained at all times. But is important that the base state takes the position of the points 16 into account as the operating state is being reached.
4) During regular operation (under stable working conditions), the positions of the points 16, and of the wires 13 respective, changes just marginally due to variations in temperatures. But the height position, and the clothing wire height position respectively, change due to the "wear" which in this connection also includes the effects of the grinding actions. The height of the points 16 accordingly diminishes with respect to the beam 24 and the wires 13 are shortened, in which arrangement the actuator system is activated by the regulator device 49, 48 in such a manner that the carding distance KA is kept as closely as possible to the target value. The envelope curve T thus forms a "reference surface" and the actuator system 50 is controlled to adjust the set of revolving flats in such a manner that the carding distance KA is maintained with respect to the reference surface.

The regulating procedure is not restricted to the application of the electronic gauge according to the FIG. 4 nor to the use of a measuring device arranged at one only measuring point, even if the illustrations for simplicity show only one such measuring point. Also a plurality of such measuring points, each equipped with its own measuring device, can be distributed along the flexible arches 44, 46, e.g. according to the setting positions conventionally used today where the fitter applies his measuring gauge. To each measuring device, a separate actuator system can be coordinated in such a manner that for each measuring point an individual target value can be pre-set which subsequently is maintained automatically.

According to further alternative embodiment, the measuring device can be supported by a movable support member which can be moved from one setting point to the next along a flexible arch and the carding distance can be scanned at each one of these measuring points. A measuring device with a camera is well suited in this arrangement. In principle the device even could scan (video camera) the carding distance without interruption while moving along the working area and establish a "continuous" image of the carding distance from one end of the working area to the other or over a certain "stretch" of the working area which possible could be predetermined or even be selected.

The latter alternative embodiment might not be applicable to conventional cards because of their frame structure, but it can be considered in new card designs. Image generation over the full working area (or at least over a substantial portion thereof) is desirable as information can be gained on the "general state" of the working area. Where images are to be generated at some individual points only, a control system is to be provided which activates the device at predetermined positions. The measuring device could be supported on a pivoting arm which can be pivoted about an axis aligned with the main drum axis. The measuring device also could be arranged on a carriage running on a rail extending along the flexible arch. On both sides of the card one measuring device each should be provided if possible.

The present invention is not restricted to an application within the main carding area. A similar arrangement can be applied for checking and/or controlling the distance of the doffer roll 7, or of the licker-in 3 respectively, relative to the main drum 4. The application of the measuring, scanning and controlling principles is still simpler as far as maintaining the predetermined distances of the clothing on the main drum relative to stationary elements such as stationary carding elements in the pre-carding area or fixed guide segments in the under-carding area or fixed flats on a card provided with fixed flats.

The term "envelope curve" in the present description is understood to comprise the approximation in the form as a straight "envelope line" e.g. a tangent to the envelope curve.

A modern card is equipped with a microprocessor or microcomputer control system—examples can be found in EP-A-701 012 and EP-A-31 20 133. This type control system is designated 12 in the FIG. 1. In this FIG. 1, no particular circuits are indicated between the control system 12 and the other elements of the machine, but examples of such connecting circuits can be found in the publications mentioned before and further connecting circuits are explained in the course of the following description. Also, provision of an input device (e.g. a key board) 21 for supplying data to the storage of the computer 12 is common practice.

It is possible, of course, to program a card according to different systems. The programming system chosen normally requires the user to supply certain corner data based on which the machine can be controlled, which corner data in most cases will comprise a combination of one sort or another of sliver weight (ktex), delivery speed (m/min), and production rate (kg/h). Based on such corner data, the control system is capable of generating control signals for the various elements in such a manner that the target values pre-set by the user are met over the duration of the operation and to check the results achieved. For this purpose, the machine is equipped with sensors (not shown in the FIG. 1) supplying signals to the control system. This fact has been made use of in the invention according to EP 96 101 466 as explained in the following description with reference to the FIGS. 14 to 16.

Figure 14:
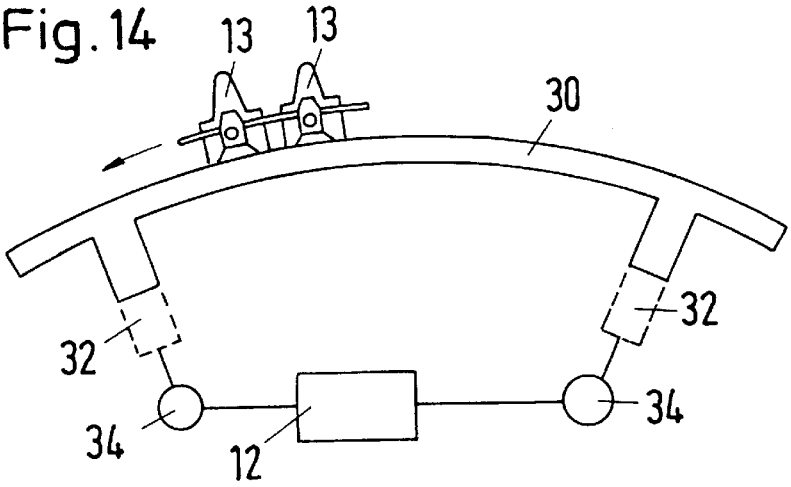
FIG. 14 is a schematic view of a flexible arch provided with a controllable actuator system.

In the FIG. 14, a part of a flexible arch 30 of a card of such type is shown with revolving flats 13 (two only being shown) circulating thereon which are slowly moved by a power grip belt (provided with cogs). Actuator elements 32 are provided on this flexible arch 30 by which the carding distance can be set. The actuator elements 32 are adjustable automatically e.g. by means of small setting motors 34 controlled by an actuator system. The actuator system is connected to the control system 12 which controls the setting of the flexible arch 30 and thus determines the carding distance e.g. according to a setting characteristic illustrated in the FIG. 15.

Figure 15:
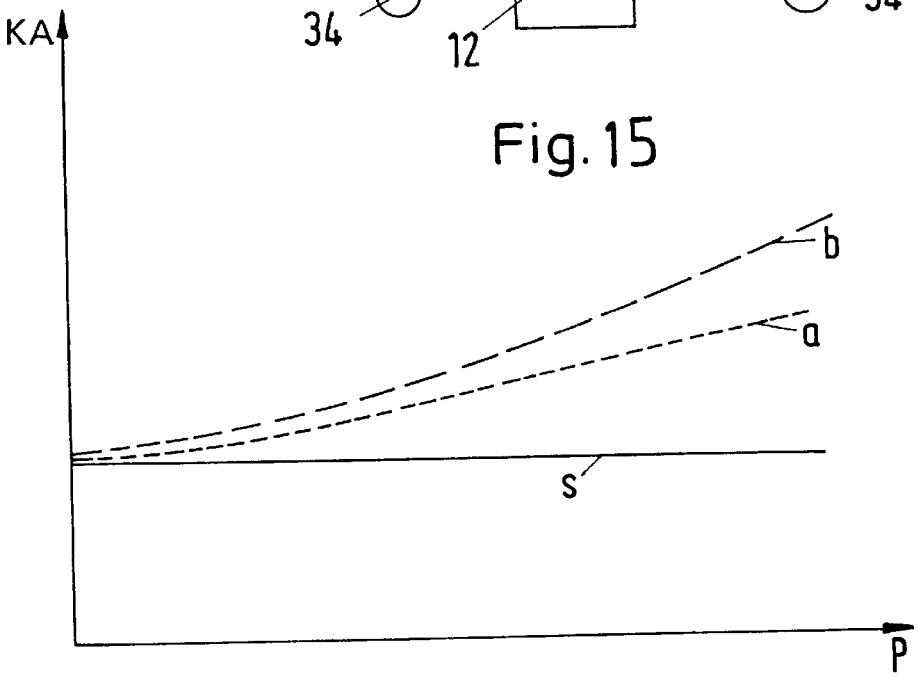
FIG. 15 is a diagram of a possibility of controlling the actuator system according to the FIG. 14.

In the FIG. 15, a diagram is shown in which the change in the carding distance KA is plotted on the abscissa as a function of the cumulated card sliver production P in tons (kg) on the ordinate for different materials processed. The curve S indicates the desired target value of the distance, i.e. the carding distance prevailing without wear of the points of the clothing on the main drum (and on the revolving flats). Depending on the carding work required for processing a certain material (influenced e.g. by the contamination, the fibre length and the nep count of the fibre material fed), more or less wear occurs as a function of the production effected as illustrated by the curves a and b for the different fibre materials A and B. The degree of wear as a function of the current production of the different fibre materials (A and B) is either known or can be determined empirically, the data obtained being supplied to the control system 12 (FIG. 1) and used for adjusting the actuator elements 32.

Total production effected starting from a given moment in time (e.g. after a change of clothing or a clothing maintenance service) is determined by the programmable control system of the machine and is displayed on demand, i.e. such data normally is available already in the machine control system. The starting "zero point" for determining the total production effected of course also can be used as a zero point for the control of the carding distance. One condition in this set-up is that the elements to be adjusted be in a predetermined state at the zero point which is to be ensured by the operating personnel. Otherwise checking of the "starting state" of the elements using a suitable sensor arrangement is required, the sensor signals being fed to the control system.

The control system 12 can be programmed by the machine supplier based on the adjustment characteristic, i.e. the characteristic is stored in the storage of the control system. The user then can recall the suitable characteristic by indicating the type material to be processed.

The adjustment preferentially does not occur continuously but intermittently (stepwise) as a function of the capabilities of the actuator system. The actuator system preferentially is capable of effecting an adjustment reliably which represents just a fraction (e.g. 10% at the most) of the normal carding distance. Such distances today are of the order of 20 to 30 hundredths of a millimeter. Preferably the actuator system can effect adjusting steps ranging from 1 to 3 hundredths.

The system is best suited for users which process a given type of material over a prolonged period of time. Computing the "total production" would prove difficult if the material in process is changed frequently.

If the type of material processed and the card production rate remain unchanged over long periods of time, and if the efficiency is predictable, the production time can be used as a control parameter instead of the production effected. The efficiency in this context is understood as the production time logged over a given time period.

A duplicate arrangement according to the FIG. 14 laid out as a mirror image must be provided on the other side of the card in order to permit adjustment of the corresponding flexible arch.

Using the embodiments already described, the carding distance can be adjusted automatically during production in a particularly simple and cost effective manner, unnecessary downtime periods thus being avoided. Basic setting or readjustment of the carding distance also can be effected as a function of the grinding of the clothing, in particular of the automatic grinding of the clothing. In this manner, the operating periods of the carding engines in a spinning mill are considerably increased without incurring noticeable quality impairment. An embodiment suitable for this type operation is described in the following with reference to the FIG. 16.

Figure 16:
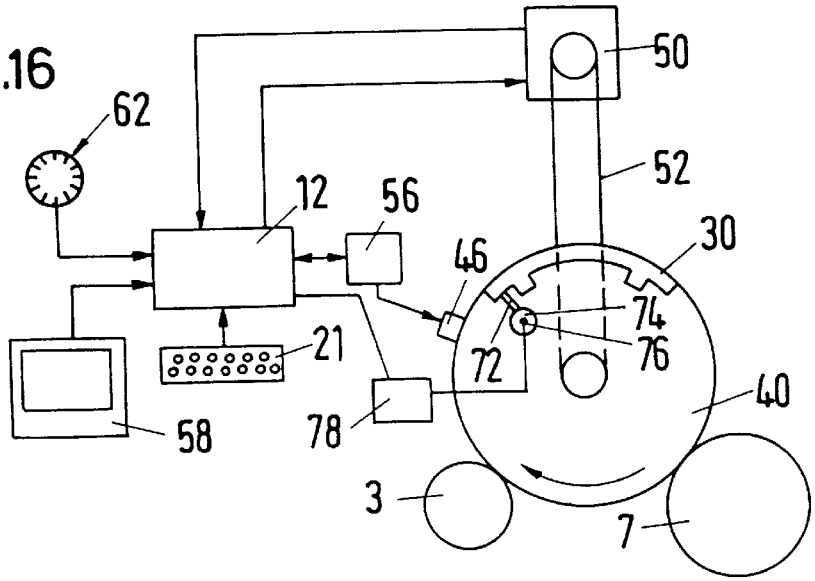
FIG. 16 is a schematic view of an expanded control system for the actuator system according to the FIG. 14.

In the FIG. 16, the main drum 4, the licker-in (taker-in) 3, and the doffer roll 7 are shown, and the grinding system which is designated 46 as a unit. This system 46 comprises a grindstone, its holder, a drive motor and means (not shown) for guiding the grindstone holder in a to and fro motion across the width of the card. In the FIG. 16, the card drive motor 50 also is shown which sets the main drum 4 in rotation e.g. via a power grip belt (provided with cogs) 52 during operation of the card. The motor 50 is controlled by signals supplied by a card control system 12 and feeds its state back to this control system. The card control system 12 also controls the grinding system 46 where, in the example illustrated, the grinding system is assumed to be equipped with a "control sub-system" 56 which effects certain control functions autonomously based on control signals supplied by the main control system 12.

This control system 12 comprises also a time signal generator indicated schematically with the reference number 62.

The main control system 12 transmits the following control signals to the control sub-system 56:

a) The number of traversing cycles of the grindstone over a certain operating phase, b) the operating speed of such movements (this could also be incorporated into the control sub-system), c) a starting signal activating an operating phase according to a pre-programmed control function.

Depending on the programming of the control system 12, fundamentally differing combinations can be imagined, namely:

1. The grinding action and the adjustment action each are controlled individually, i.e. independently (activated according to the program).
2. The adjusting action is activated upon completion of a grinding process.
3. The adjusting action and the grinding action can be activated independently of each other, where the adjusting action can be activated also upon completion of a grinding process.

The preferred solution provides the adjusting action upon completion of a grinding station, namely after completion a number of grinding cycles determined by the control system. The adjusting action, which also can be programmed, then depends on the above mentioned number of cycles as well as on the intensity of the grinding action.

According to an advantageous lay-out of the program, activation of the grinding system is not rigorously controlled on a time basis but based on the production effected. For this purpose, the user can pre-set the clothing life span, expressed as the total quantity produced (tons), he desires in the control system. According to a given characteristic stored in the storage of the control system, the latter can decide on the frequency of the grinding actions to be performed. This characteristic possibly is to be adapted to the type of material processed and/or to the type clothing used, or the appropriate type is to be called up from the storage respectively. This characteristic in turn determines the total number of grinding cycles (to and fro traverse movements of the grindstone) over the chosen life span of the clothing, as well as the distribution of these grinding cycles over the life span of the clothing.

The adjustment of the flexible arch now can be controlled based on the same characteristic as it probably will be possible only after some grinding cycles to take care of the change in the shape of the points by adjusting the flexible arch.

As clarified particularly in the FIG. 16, the control system 12 also can take into account also other parameters relevant for the carding gap, e.g. the rotational speed of the main drum 4 (the rotational speed of the motor 50) and/or the operating temperature at selected points where temperature gauges (not shown) can be arranged which transmit their output signals to the control system 12 also.

As far as the regulating system according to the FIG. 13 is capable of reliably maintaining the carding distance KA at a predetermined target value, no need arises to take into account the various parameters discussed with reference to the FIGS. 15 and 16. The system schematically shown in the FIG. 13 depends on the output signal of the sensor 26 or on the analysis of said signal. Certain plausibility tests can be incorporated into the electronic system itself in order to reduce the risk of malfunction, in which-arrangement redundancy will hardly be applicable as a safety measure for cost reasons, however. The consequences of a malfunction are considerable (possibly disastrous) as normally the points 20 "approach" the points 16—with the corresponding risks spread from "simple brushing" (sparks, possible fire hazard, damage to clothings, loss in quality due to faulty fibre processing) to a collision of the set of revolving flats with the main drum.

Basically the plausibility of the measured values, or of the signals respectively, supplied to the control system depends on the "operating condition" of the machine. The relevant information concerning these conditions is not stored in the electronics of the sensor system but in the control system 12, as explained in the following with reference to the FIG. 17. This FIG. 17 shows two flat clothing wires 20 and one point 16, which are sufficient for explaining the principle.

In a "basic setting" (immediately after mounting new clothing), the point 16 has a height H and a pre-set distance KA prevails between the wires 20 and the point 16. During the life span of the clothing on the main drum, the height of the point 16 is reduced (due to wear and grinding) to h. The carding distance KA, however, is to be maintained constant in such a manner that the tips of the wires then should be located on the plane E (dash-dotted line). For offsetting the "loss" incurred by the clothing on main drum, the set of revolving flats thus must approach the main drum over a distance differential (H-h) which of course is effected over the life span of the clothing. This amount of approach however is insufficient as the wires 20 in the meantime are shortened by an amount B (due to working wear to grinding) which also is to be offset by the "approach" movement (the ratios H/h and B/H are not to be understood as practical values, but only to be considered illustrations explaining the principle). The total approaching movement is designated W.

Figure 17:
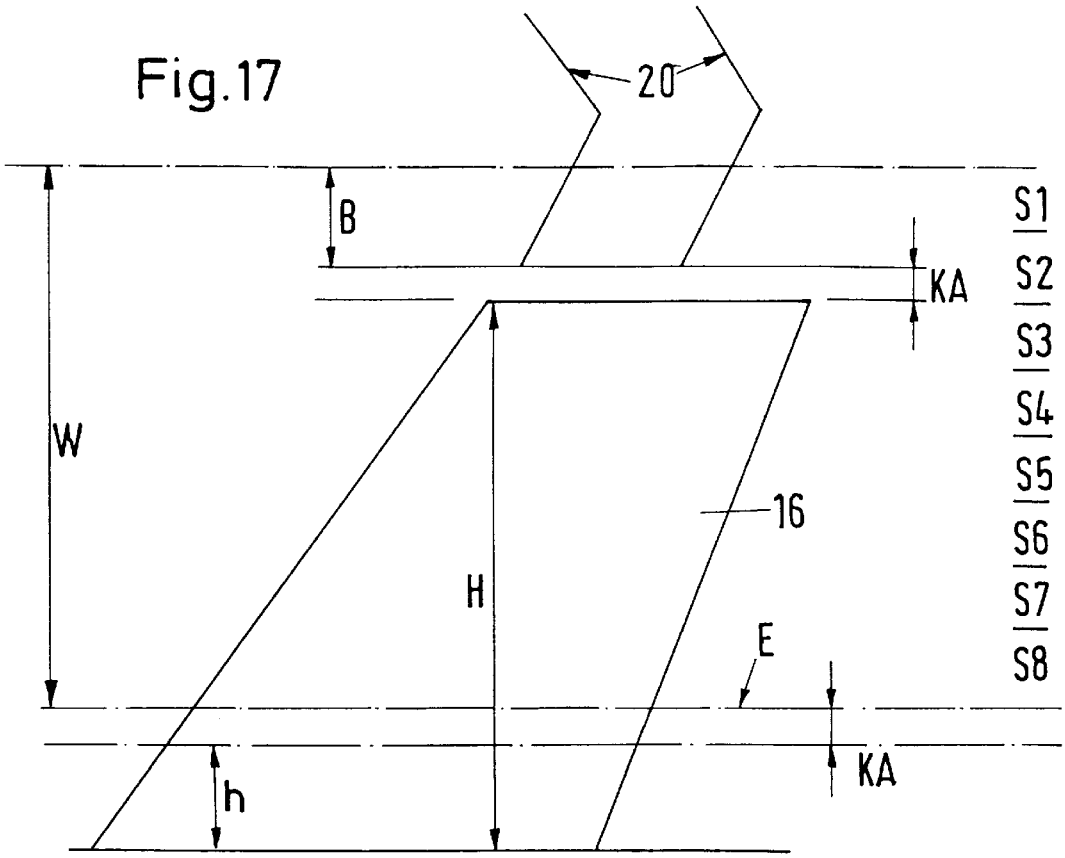
FIG. 17 is a diagram explaining the necessity of certain limitations for the regulating system according to the FIGS. 4, and 13 respectively, and in FIG. 18 is a diagram explaining a modification of the arrangement according to the FIG. 14 according to the preferred embodiment of the present invention.

As mentioned above, the approaching movement is to be effected stepwise in such a manner that the full path W can be subdivided into e.g. eight steps S1 to S8 (compare the right hand side margin of the FIG. 17). Based on the data known to the machine manufacturer, it is still possible to determine in the programming of the control system e.g. after how many hours of operation an approaching step S1 will be plausible. The same holds true for the steps S2 to S8. If the measuring device (for whatever reason) demands an "approaching step" before the pre-set number of operating hours has elapsed, which is not plausible, the control system 12 can prevent the step demanded from being effected.

The behaviour of the system furthermore depends on the layout of the program and of the control system 12. The controlling programs can e.g. be structured in such a manner that already if a first "error signal" occurs, the regulating mechanism employing the measuring device 26, 28 is switched off. It is improbable, however, that this must result in a stoppage of the machine. The control system 12 thus can send a "defect signal", but the machine can continue to work whereby the control system 12 still is capable to control the approaching movement according to the principles which were explained with reference to the FIGS. 15 and 16. The control system 12 on the other hand could simply "block off" the faulty signals supplied by the measuring device 26, 28 but could take into account plausible signals, the defects being signalled in such a manner that they can be checked by the operating personnel.

Figure 18:
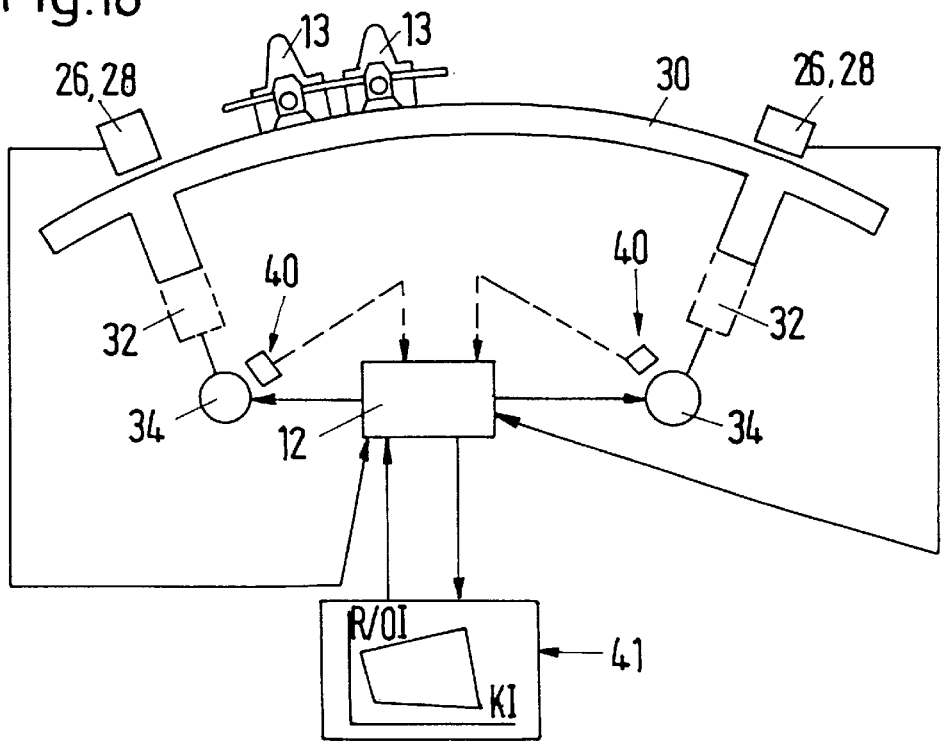

In the FIG. 18 a modification is shown of the arrangement according to the FIG. 14 in which for each motor 34 a corresponding measuring device 26, 28 is provided at the working area of the main carding area each supplying corresponding measuring signals to the control system 12 (two measuring points, two setting positions). Each motor additionally could be provided with a "position sensor" 40, e.g. an encoder or an angle measuring device which signals the current position to the control system 12. In this case it is possible to e.g. use the base setting as a reference value for a position check which permits further plausibility tests to be effected.

In the FIG. 18, also on the "display screen" 41, the preferred solution for pre-programming of the machine is shown which facilitates the input of data for the user. The control system 12 can be programmed according to the diagram principle, which is discussed in EP-A-452 676 and which publication is referred to for further details. The diagram shown is two-dimensional and shows the parameter vector "carding intensity" KI plotted against "cleaning and opening intensity" RO/I. The carding intensity KI is influenced by the carding distance KA which now can be controlled using the embodiments already described and is to be pre-set as a target value by the user. The cleaning intensity is influenced e.g. by the rotational speed of the main drum and of the licker-in (if the licker-in is equipped with a separate drive) and these values also are to be set also by the user using the control system 12. It is not essential for the present invention that the diagram principle be applied for pre-programming the machine, as the individual settings could be set individually by the user. The diagram principle simplifies operation of a machine in which complex interactions occur between the various setting possibilities, as e.g. in a card.

It should be apparent to those skilled in the art that various modifications and variations can be made in the present invention without departing from the scope and spirit of the invention. It is intended that the present invention cover such modifications and variations as come within the scope of the appended claims and their equivalents.

We claim:

1. A textile card machine, comprising oppositely facing clothings disposed across a working width of said card machine, at least one of said clothings movable in a working direction within said working width, each said clothing comprising individual projections protruding from a support surface wherein a carding gap is defined between opposite said support surfaces and a working distance is defined between opposite said projections, said working distance changing over time as a function of operating conditions, said card machine further comprising a scanner disposed on a side of said working width to scan said working distance in a scanning direction transverse to said working direction of said movable clothing.

2. The textile machine as in claim 1, wherein said working width is defined by sides, said scanner scanning said working width entirely between said sides.

3. The textile machine as in claim 1, wherein said scanner comprises a light beam emitting scanner.

4. The textile machine as in claim 3, wherein said scanner generates a light beam across said working width, said light beam having dimensions so that it is at least partially scattered by said projections.

5. The textile machine as in claim 4, further comprising a receiver disposed opposite said scanner to receive an unscattered portion of said light beam, said unscattered portion providing a measurement of said working distance.

6. The textile machine as in claim 1, wherein said scanner comprises a camera disposed to produce images of said projections across said working width.

7. The textile machine as in claim 6, further comprising means for analyzing said images.

8. The textile machine as in claim 1, further comprising means for attaching said scanner along said side of said working width.

9. The textile machine as in claim 8, wherein said attaching means is movable along said side of said working width.

10. The textile machine as in claim 1, further comprising an actuator system for moving one of said clothings thereby adjusting said carding gap to maintain said working distance between said projections.

11. The textile machine as in claim 10, wherein said actuator system is responsive to said scanner.

12. A method for scanning and adjusting a working distance between clothings of a textile card machine wherein the clothing includes oppositely facing projections extending from respective support surfaces, the working distance being the space between the oppositely facing projections, said method comprising scanning the working distance between oppositely facing projections from a side of a working width of the clothings in a scanning direction transverse to a moving direction of one of the clothings and measuring changes in said working distance, and automatically adjusting a carding gap defined as the distance between the oppositely facing support surfaces with an adjusting system operating in response to the scanned working distance.

13. The method as in claim 12, wherein said scanning comprises projecting a light beam across said working width so that at least a portion of the light beam is scattered by the projections, and detecting an unscattered portion of the light beam as a measurement of the working distance.

14. The method as in claim 12, wherein said scanning comprises producing images of said projections with a camera and analyzing the images to detect changes in the working distance.

15. The method as in claim 14 further comprising producing an envelope curve from said images and using the envelope curve in said automatic adjusting of the carding gap.

16. The method as in claim 15, comprising generating the envelope curve by superimposing multiple images of the projections.

17. The method as in claim 15, comprising generating the envelope curve by adjusting shutter speed of the camera relative to movement of the clothing.

18. The method as in claim 14, further comprising digitizing and storing the images prior to said analyzing.

19. A method for scanning and adjusting the working distance between oppositely facing clothing projections in a textile card machine, the projections extending from oppositely facing support surfaces, said method comprising scanning the working distance between oppositely facing projections from a side of the clothings in a scanning direction transverse to a working moving direction of said clothings and generating a reference envelope curve from said scanning, and thereafter repeating said scanning and comparing results thereof to said envelope curve and adjusting the working distance to compensate for changes therein by automatically moving at least one of the support surfaces to vary the working distance between the projections.

20. The method as in claim 19, wherein said scanning comprising optically scanning the working distance with a light beam.

21. The method as in claim 20, wherein said optically scanning comprises generating images of the projections defining the working distance with a camera.

22. The method as in claim 19, wherein said scanning comprises projecting a light beam into said working distance so that at least a portion of the light beam is scattered by the projections, and detecting an unscattered portion of the light beam as a measurement of the working distance.

23. A method for adjusting a carding gap in a textile card machine to account for changes over time in the size of clothing projections within the carding gap, the carding gap defined between a clothing having a plurality of projections extending from a support member and a machine element disposed opposite from the projections and support member, said method comprising:

sensing with a sensor system measuring values for parameters of the card machine indicative of an actual state of the carding gap due to changes in the projections over time;

transmitting the measuring values to a control system and analyzing the measuring values to determine the actual state of the carding gap;

establishing pre-set conditions of the card machine that are indicative of expected changes in the carding gap due to operational conditions over time;

determining if the measured values indicating the actual state of the carding gap requiring a correction of the carding gap are plausible with respect to the pre-set operational conditions over time at the time of said sensing step; and, if so with a regulating system operating in response to the control system and connected to a controllable actuator system configured with at least one of the clothing or machine element, reducing the carding gap by moving at least one of the clothing or machine element in response to the sensed measuring values independent of the pre-set conditions over time.

24. The method as in claim 23, further comprising deactivating the regulating system if the measured values fall outside of an acceptable plausibility range when compared with the pre-set conditions.

25. The method as in claim 24, further comprising adjusting the carding gap with control signals from the control system after the regulating system is deactivated.

26. The method as in claim 23, further comprising defining an approach limit for the regulating system for preventing excessive adjustments of the carding gap resulting from faulty scanned measuring or faulty analyzing of the measuring values.

27. The method as in claim 23, further comprising establishing the pre-set conditions from any combination of operating time since a last maintenance service, total production of the card machine since a last maintenance service, type of material processed by the card machine, and the cumulative effect of built-in maintenance devices.

28. The method as in claim 23, further comprising detecting with a sensor data which directly indicates satisfaction of at least one of the pre-set conditions based on changes in the pre-set condition from a baseline setting.

29. The method as in claim 28, wherein said sensing with a sensor system comprises scanning the carding gap from a side thereof in a scanning direction transverse to a moving direction of the clothing, the measuring values indicating working distance between the projections on the clothing and opposite projections on the element.

* * * * *